US008920568B2

(12) United States Patent
Taylor

(10) Patent No.: US 8,920,568 B2
(45) Date of Patent: Dec. 30, 2014

(54) METHOD FOR THE DISSOLUTION OF AMORPHOUS DITHIAZINE

(75) Inventor: Grahame N. Taylor, Jersey Village, TX (US)

(73) Assignee: Baker Hughes Incorporated, Houston, TX (US)

( * ) Notice: Subject to any disclaimer, the term of this patent is extended or adjusted under 35 U.S.C. 154(b) by 551 days.

(21) Appl. No.: 13/073,924

(22) Filed: Mar. 28, 2011

(65) Prior Publication Data

US 2012/0247515 A1 Oct. 4, 2012

(51) Int. Cl.
*B08B 7/00* (2006.01)
*C11D 11/00* (2006.01)
*C11D 7/06* (2006.01)

(52) U.S. Cl.
CPC ..... *C11D 11/0041* (2013.01); *C11D 7/06* (2013.01)
USPC ..... 134/4; 134/22.1; 134/22.11

(58) Field of Classification Search
None
See application file for complete search history.

(56) References Cited

U.S. PATENT DOCUMENTS

| | | | |
|---|---|---|---|
| 4,271,132 | A | 6/1981 | Eickmeyer |
| 4,452,764 | A | 6/1984 | Oakes et al. |
| 4,491,527 | A | 1/1985 | Lange et al. |
| 4,569,766 | A | 2/1986 | Kool et al. |
| 4,806,229 | A | 2/1989 | Ferguson et al. |
| 4,978,512 | A | 12/1990 | Dillon |
| 5,074,991 | A | 12/1991 | Weers |
| 5,128,049 | A | 7/1992 | Gatlin |
| 5,347,004 | A | 9/1994 | Rivers et al. |
| 5,376,749 | A | 12/1994 | Miller et al. |
| 5,413,627 | A | 5/1995 | Landeck et al. |
| 5,462,721 | A | 10/1995 | Pounds et al. |
| 5,478,541 | A | 12/1995 | Samuels et al. |
| 5,554,349 | A | 9/1996 | Rivers et al. |
| 5,655,601 | A | 8/1997 | Oddo et al. |
| 5,674,377 | A | 10/1997 | Sullivan, III et al. |
| 6,063,346 | A | 5/2000 | Luna |
| 6,180,057 | B1 | 1/2001 | Taylor et al. |
| 6,267,938 | B1 | 7/2001 | Warrender et al. |
| 6,582,624 | B2 | 6/2003 | Titley et al. |
| 6,663,841 | B2 | 12/2003 | Salma et al. |
| 6,964,940 | B1 | 11/2005 | Treybig et al. |
| 7,264,786 | B2 | 9/2007 | Pakulski et al. |
| 8,022,017 | B2 | 9/2011 | Taylor |
| 8,022,018 | B2 | 9/2011 | Taylor |
| 8,354,361 | B2 | 1/2013 | Taylor |
| 8,734,637 | B2 | 5/2014 | Taylor |
| 2008/0197085 | A1 * | 8/2008 | Wanner et al. ..... 210/752 |

FOREIGN PATENT DOCUMENTS

| | | | |
|---|---|---|---|
| WO | WO 9201481 | A1 | 2/1992 |
| WO | WO/2008/049188 | | 2/2008 |

OTHER PUBLICATIONS

Jan M. Bakke, Janne Buhaug & Jaroslav Riha, "Hydrolysis of 1,3,5,-Tris(2-hydroxyethyl)hexahydrodithiazine and Its Reaction with H2S", 40 Ind. Eng. Chem. Res. 2001, 40, pp. 6051-6054.

(Continued)

*Primary Examiner* — Eric Golightly
(74) *Attorney, Agent, or Firm* — John Wilson Jones; Jones & Smith, LLP

(57) ABSTRACT

A method for the dissolution of amorphous dithiazine buildup on a surface is presented. The method consists of treating the dithiazine buildup with a solution of hydrogen peroxide, which reacts and breaks apart the buildup for easy removal.

9 Claims, 2 Drawing Sheets

(56) References Cited

OTHER PUBLICATIONS

Grahamme N. Taylor & Ron Matherly, Gas Chromatographic-Mass Spectroscopic Analysis of Chemically Derivatized Hexahydrotriazine-based Hyrdrogen Sulfide Scavengers: Part II, 49 Ind. Eng. Chem. Res. 6267 (2010).

Grahame N. Taylor & Ron Matherly, "Structural Elucidation of the Solid Byproduct from the Use of 1,3,5-Tris (hydroxyalkyl)hexahydro-s-triazine Based Hydrogen Sulfide Scavengers", Ind. Eng. Chem. Res. 2011, 50, pp. 735-740.

* cited by examiner

METHOD FOR THE DISSOLUTION OF AMORPHOUS DITHIAZINE

FIELD OF THE INVENTION

The present invention relates to a method for removing amorphous dithiazine from a surface.

BACKGROUND OF THE INVENTION

Hydrogen sulfide ($H_2S$) and organic sulfides are found within geological formations associated with oil and gas reserves. Due to their toxicity and corrosive nature, they are generally reduced or removed from hydrocarbon streams during production in a process called "sweetening." A common approach is to use an $H_2S$ scavenger, particularly triazine, which is produced by an aldehyde and an amine reaction. The $H_2S$ scavenger subsequently reacts with the hydrogen sulfide converting it to a more non-volatile product, which can be more easily removed from the hydrocarbon stream. Typical formulations use a low molecular weight aldehyde such as formaldehyde, but ketones can also be used. The amines can be alkylamines as disclosed in U.S. Pat. No. 5,674,377 (filed Jun. 19, 1995), alkanolamines as disclosed in U.S. Pat. No. 4,978,512 (filed Dec. 18, 1989), or even a combination of amines as disclosed in U.S. Pat. No. 6,267,938 B1 (filed Nov. 4, 1996), U.S. Pat. No. 5,347,004 (filed Oct. 9, 1992), and U.S. Pat. No. 5,554,349 (filed Sep. 8, 1994).

While amine-based $H_2S$ scavengers are effective at removing hydrogen sulfide from hydrocarbon streams, they are also known to form an unwanted dithiazine byproduct. This so-called amorphous dithiazine is exceptionally insoluble, and substantial quantities can deposit throughout the gas processing system. Dithiazine deposits are a significant problem to the gas processing industry. They can form blockages in gas processing equipment, storage tanks, truck tanks, and water disposal wells. Cleanup procedures are time consuming and difficult. Often, the equipment has to be taken off-line so the deposits can be manually chipped away. The industry places much effort and incurs great cost in the treatment of amorphous dithiazine buildup.

SUMMARY OF THE INVENTION

The present invention relates to a method of treatment for the problem of amorphous dithiazine buildup on a surface. It has been found that a solution of hydrogen peroxide will react and dissolve the amorphous dithiazine precipitate, allowing for easy removal.

DETAILED DESCRIPTION OF THE PREFERRED EMBODIMENTS

Figure 1:
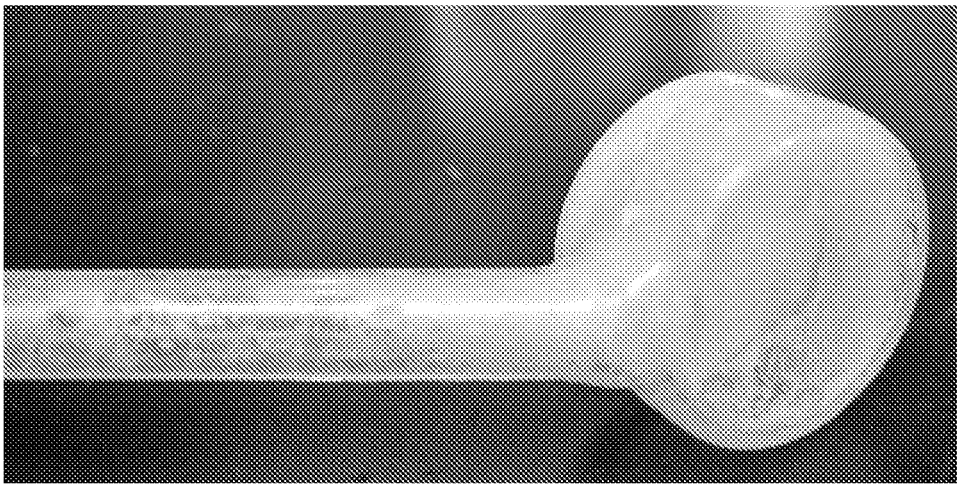
Figure 1 (Prior Art)
FIG. 1 depicts a glass rod covered in amorphous dithiazine.
Figure 2:
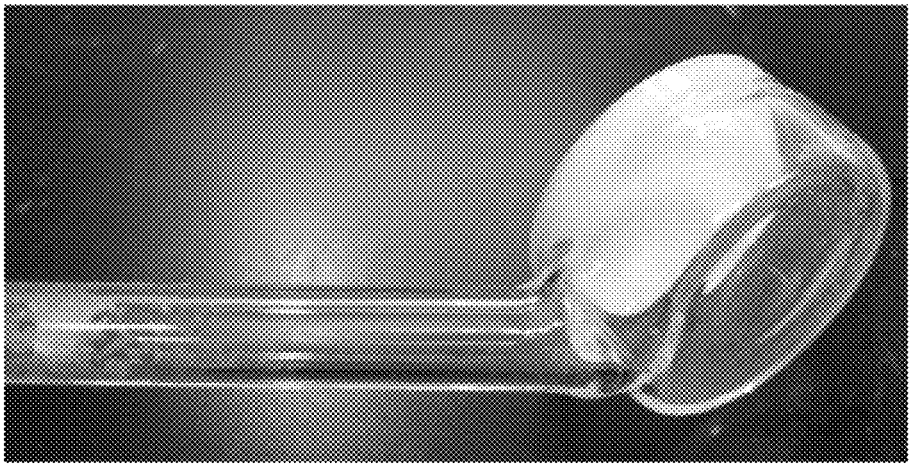
FIG. 2 depicts the glass rod of FIG. 1 after treatment with hydrogen peroxide.

Illustrative embodiments of the invention are described below as they might be employed in the operation and treatment of oilfield applications. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but may nevertheless be a routine undertaking for those of ordinary skill in the art having the benefit of this disclosure. Further aspects and advantages of the various embodiments of the invention will become apparent from consideration of the following description.

It is well established that the byproduct from the use of the common $H_2S$ scavenger 5-(2-hydroxyethyl)hexahydrotriazine (structure I) is 5-(2-hydroxyethyl)dithiazine (structure II). See, e.g., Jan M. Bakke, Janne Buhaug & Jaroslav Riha, *Hydrolysis of* 1,3,5,-*Tris*(2-*hydroxyethyl*)*hexahydrodithiazine and Its Reaction with* $H_2S$, 40 Ind. Eng. Chem. Res. 6051 (2001); Grahame N. Taylor & Ron Matherly, *Gas Chromatographic-Mass Spectroscopic Analysis of Chemically Derivatized Hexahydrotriazine-based Hydrogen Sulfide Scavengers: Part II,* 49 Ind. Eng. Chem. Res. 6267 (2010).

(I)

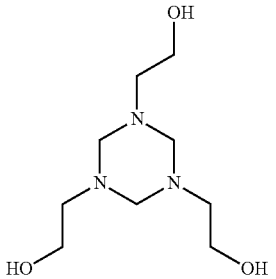

(II)

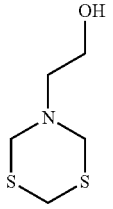

When initially produced (II) exists in the form of a lower, dense liquid layer in the gas tower which can under certain conditions actually crystallize to form a low melting, highly crystalline solid. However, another form of this material is also very common and has been referred to as amorphous dithiazine. See Formulation For Hydrogen Sulfide Scavenging From Hydrocarbon Streams And Use Thereof, WO/2008/049188 (filed Oct. 26, 2006). It is a fine, powdery, highly insoluble solid that represents a "so-called" different physical form of the same chemical species. Recently, amorphous dithiazine has been synthesized under laboratory conditions and compared with amorphous dithiazine found in oil field operations. Grahame N. Taylor & Ron Matherly, *Structural Elucidation of the Solid Byproduct from the use of* 1,3,5,-*Tris* (2-*hydroxyethyl*)*hexahydro-s-triazine Based Hydrogen Sulfide Scavengers* 50 Ind. Eng. Chem. Res. 735 (2011). X-ray diffraction analysis, elemental analysis, IR spectroscopy and NMR spectroscopy were performed on these samples and the data indicate that the amorphous dithiazine structure has repeating units of sulfur bonds. It is believed that the polymeric structures of amorphous dithiazine in idealized form are shown by structures (III) and (IV).

(III)

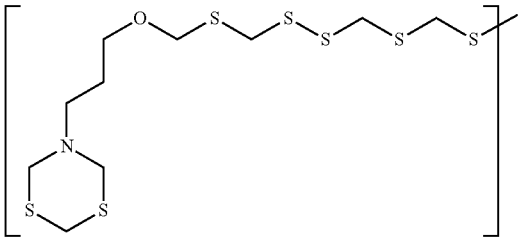

(IV)

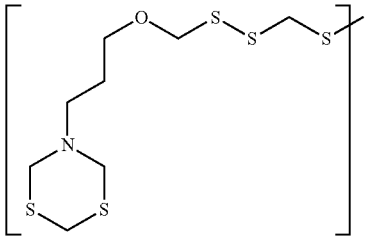

Taylor and Matherly proposed that the mechanism for the polymer propagation is shown in Scheme 1. Id. at 739-740. These structures can be explained by the transient generation of the highly reactive species, thioformaldehyde, which rapidly reacts with the hydroxyl terminus of the dithiazine and builds a linking chain. Sulfur insertion occurs at some point to generate the polysulfide linkages. The terminus reacts with another dithiazine molecule by nucleophilic substitution and ring opening via protonation of the nitrogen. Once the second dithiazine molecule has been incorporated into the growing chain, further thioformaldehyde molecules are added and the process repeats. The molecular structures shown depict the average content of the side chains which have a degree of variability within the bridging portion. It is these sulfur containing side chains that give the amorphous dithiazine its amorphous structure and insoluble nature.

Scheme 1

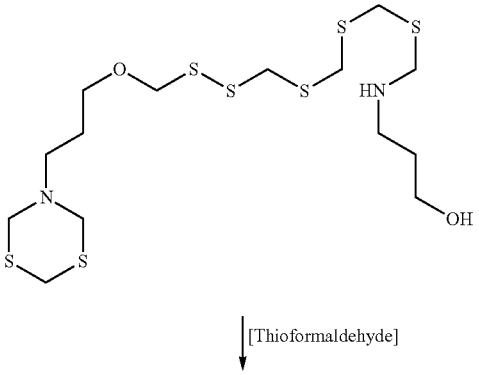

-continued

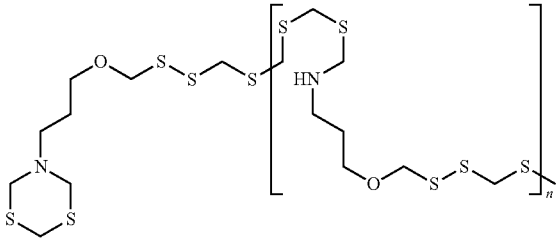

It is believed that the thioformaldehyde is generated as the scavenger fluid is spent with hydrogen sulfide and the pH drops increasing the extent that (I) hydrolyzes back to formaldehyde and monoethanolamine. As soon as the formaldehyde is formed it competes with (I) in reacting with the hydrogen sulfide producing thioformaldehyde. Id. at 740.

While not wanting to be bound by any mechanism or theory, it is believed that the dissolution of amorphous dithiazine is caused by the oxidation of sulfide (S valence state 2) to the more soluble sulfoxide (S valence state 4) as shown in Scheme 2. Hydrogen peroxide is particularly effective at oxidizing the sulfur atoms of the side chains. This leads to the breaking apart and dissolution of the amorphous dithiazine precipitate.

Scheme 2

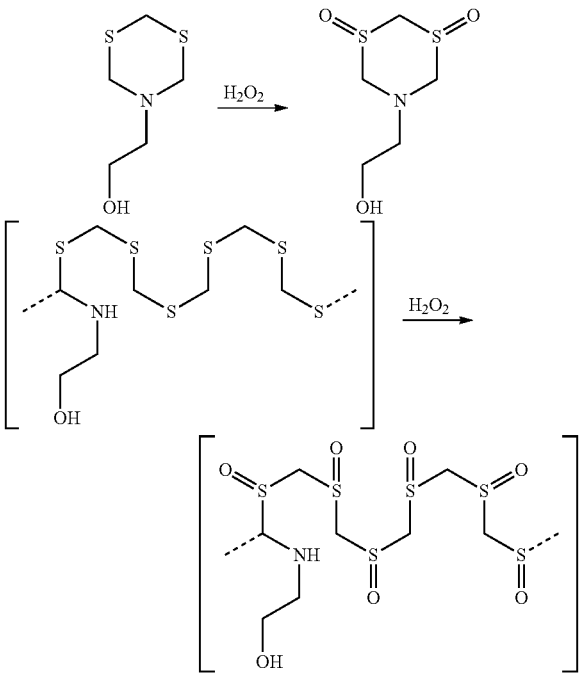

In a preferred embodiment of the present invention, a surface that is partially covered in amorphous dithiazine buildup is put in contact with an aqueous solution of hydrogen peroxide. The surface may be prepped by having any extraneous oxidizable material rinsed from the amorphous dithiazine coated surface. For example, any gas processing fluids may be rinsed away. The rinse may be done with water or any solvent that would effectively remove the extraneous oxidizable material. This permits the oxidizing power of hydrogen peroxide to react primarily with the amorphous dithiazine. Then, an aqueous solution of hydrogen peroxide is introduced onto the surface partially covered in amorphous dithiazine. The concentration of hydrogen peroxide may be between about 5% to about 50% by volume. The concentration may be of commercial strength of about 34% by volume; however, this solution may be concentrated or diluted upon what the user determines to be effective at removing amorphous dithiazine. Also, the user may decide to dilute the hydrogen peroxide for safety reasons.

The solution of hydrogen peroxide is between ambient temperatures and 80° C. The solution may be heated prior to introducing onto the amorphous dithiazine coated surface or after it has already been placed in contact with the surface.

The solution of hydrogen peroxide is left to react and dissolve a portion of the amorphous dithiazine. The user may find it necessary to leave the hydrogen peroxide in contact with the amorphous dithiazine for several hours before an effective amount has dissolved. During this time, the mixture may be stirred or triturated to increase the effectiveness of the reaction. Sonication of the mixture may also be used.

After the user has determined that an effective amount of amorphous dithiazine has been dissolved, the solution of hydrogen peroxide and dissolved amorphous dithiazine is removed from the surface or substrate. The surface may be rinsed with water or any solvent that would remove any remaining remnants.

After the amorphous dithiazine precipitate has been treated with hydrogen peroxide, the user may want to use physical removal of a portion of the amorphous dithiazine. This may include manual chipping and scrapping of the amorphous dithiazine precipitate. This physical removal may be used to expose an unreacted layer of amorphous dithiazine buildup.

The user may decide that another treatment of hydrogen peroxide may be used to remove additional amorphous dithiazine from the substrate. The substrate containing the amorphous dithiazine may again be placed in contact with the hydrogen peroxide to further react and dissolve. The user may use a recursive procedure of chemically removing a portion of the amorphous dithiazine with hydrogen peroxide and physically removing a portion of the amorphous dithiazine until an effective amount of the amorphous dithiazine has been removed.

Amine-based $H_2S$ scavengers are used in gas tower contactors; hence, large deposits of amorphous dithiazine are typically found there. In an aspect, the present invention may be used to remove a portion of the amorphous dithiazine from the gas tower contractors. The gas tower contractors may be flushed with water or any solvent that would remove any leftover hydrocarbon processing fluids. A solution of hydrogen peroxide is then injected into the gas tower contactor. The solution may be heated before or after injection. After an effective amount of the amorphous dithiazine had been dissolved the solution is removed. Sequential treatments of hydrogen peroxide may be used.

After a hydrocarbon stream has been sweetened with amine-based $H_2S$ scavengers, precipitation of amorphous dithiazine occurs throughout the hydrocarbon processing conduit. In an aspect, the present invention may be used to remove a portion of the amorphous dithiazine from conduit. A solution of hydrogen peroxide is injected into the flow conduit. The solution is kept in contact with the amorphous dithiazine until an effective amount has been removed. The hydrogen peroxide may be heated prior to or after the injection.

Amorphous dithiazine tends to precipitate in restrictions and "dead spots" of hydrocarbon processing systems. Places in the system where there is abrupt physical change, such as a change in temperature or pressure, can be prone to amorphous dithiazine buildup. For example, injection ports and valves are susceptible. In an aspect, the present invention may be used to remove the amorphous dithiazine from smaller pieces of hydrocarbon systems. A part that is partially covered in amorphous dithiazine is removed from the hydrocarbon system and placed in a reservoir of hydrogen peroxide solution. The part may be partially or fully submerged. The reservoir of hydrogen peroxide may be attached to a heating apparatus to bring the solution to the desired temperature. The reservoir may be partially or fully enclosed to limit the vapor release.

Hydrocarbons that have been sweetened with amine-based $H_2S$ scavengers and have been sitting stationary for long periods of time tend to have amorphous dithiazine precipitate out of solution and form deposits on the bottom of their storage vessels. For example, truck tanks and disposal wells can have dithiazine buildup. In an aspect, the present invention may be used to remove the amorphous dithiazine from contained areas. A solution of hydrogen peroxide is applied to the surface that is coated with the amorphous dithiazine. The solution of hydrogen peroxide may be heated and sprayed onto the surface. After a portion of the amorphous dithiazine buildup has reacted with the hydrogen peroxide, water or another solvent may be used to rinse away the solution and any remnants that have formed due the reaction. In an aspect, a portion of the amorphous dithiazine may be removed physically. Physical removal may include manually chipping and scrapping at the amorphous dithiazine deposit. After a layer of unreacted amorphous dithiazine has been exposed, another treatment of hydrogen peroxide may be applied to further react and breakdown the amorphous dithiazine. The user may try multiple treatments of hydrogen peroxide until an effective portion of amorphous dithiazine buildup has been removed.

EXAMPLE

The following example describes the preferred embodiments of the present invention. Other embodiments within the scope of the claims will be apparent to one skilled in the art from the consideration of the specification or practice of the invention disclosed herein.

Amorphous dithiazine can be prepared in a laboratory experiment or gathered from highly spent fluids in field locations. A field strength solution (30% by mass of active hexahydrotriazine), typical for the oilfield application of (I), was spent with pure hydrogen sulfide in a glass gas tower. The mass of hydrogen sulfide absorbed by the fluid was measured by the mass increase of the gas tower. A considerable exotherm of between 20-30° C. was observed during the reaction to form the expected dithiazine. At reaction completion, full theoretical mass of hydrogen sulfide had been absorbed, namely 4 moles of hydrogen sulfide per mole of (I). Initially, (II) was seen to separate in the bottom of the gas tower as a lower colorless liquid but within one hour a very heavy white solid deposited in the fluid of the gas tower and the lower layer solidified into a fine white powder. Attempts to arrest the solidification of the lower layer by separating and dissolving in methanol were not successful. The fine white solid was the laboratory analogue of amorphous dithiazine observed in the field use of (I).

Several field locations where (I) was in use were known to deposit heavy quantities of amorphous dithiazine as a somewhat troublesome byproduct. Samples of spent fluid were obtained that contained both liquid (II) and amorphous dithiazine solids. It was convenient to separate these as follows. At elevated temperatures (II) existed in a liquid phase containing amorphous dithiazine floating throughout the bulk of the fluid. This heterogeneous fluid was filtered hot under reduced pressure. The liquid dithiazine, when collected in the filtration flask, was free of the amorphous dithiazine, and may often solidify and form large, high quality crystals of (II). The oil field derived samples of amorphous dithiazine were washed with methanol and dried under vacuum to produce a fine off-white to grey free flowing powder. The laboratory synthesized amorphous dithiazine and the purified field amorphous dithiazine were examined by X-ray diffraction analysis, elemental analysis, IR spectroscopy and NMR spectroscopy. The results indicated that the laboratory-produced, amorphous dithiazine and the field purified, amorphous dithiazine had similar chemical composition and structure.

For both laboratory prepared and field purified amorphous dithiazine, the solid was gathered by initial filtration and re-suspended by stifling in deionised water followed by another filtration. The solid filter cake is pressed to remove as much water as possible. It was then washed again with deionised water to remove contaminants. The wet filter cake was washed with isopropanol to remove excess water. The filter cake was broken up and dried to a constant weight in a vacuum oven at 60° C. The dry solid was crushed into a fine, free-flowing powder and used for the solid dissolution studies.

The hydrogen peroxide solution was made by dilution of commercial 34% (vol) strength (e.g. Fisher Scientific). The solid amorphous dithiazine was then added to the aqueous solution of hydrogen peroxide. The mixture was stirred and heated. At a temperature of about 65-70° C. the dissolution process occurred. Stirring at this temperature for approximately 1 hour, the amorphous dithiazine dissolved according to the data shown in Table 1.

TABLE 1

| Strength of Hydrogen Peroxide Solution (vol %) | Maximum Solubility Observed (%) |
|---|---|
| 34.0 | 4.5-5.0 |
| 17.0 | 4.5-5.0 |
| 8.5 | 3.0 |
| 0.0 | 0.0 |

The aqueous solution of hydrogen peroxide reacted and dissolved amorphous dithiazine up to 5% (mass) readily.

Other embodiments within the scope of the claims herein will be apparent to one skilled in the art from consideration of the description set forth herein. It is intended that the specification, together with the examples, be considered exemplary only, with the scope and spirit of the invention being indicated by the claims which follow.

What is claimed is:

1. A method of removing amorphous dithiazine from a surface at least partially coated with amorphous dithiazine comprising reacting the amorphous dithiazine with an amount of hydrogen peroxide determined to be effective to dissolve at least a portion of the amorphous dithiazine.

2. The method of claim 1, wherein the solution of hydrogen peroxide is in the temperature range of ambient temperatures to about 80° C.

3. A method of removing amorphous dithiazine from a substrate which comprises:

a. introducing onto the substrate a solution of hydrogen peroxide;

b. reacting the amorphous dithiazine with the solution of hydrogen peroxide; and c. removing from the substrate the hydrogen peroxide solution with at least a portion of the amorphous dithiazine dissolved.

4. The method of claim 3, wherein materials reactive with hydrogen peroxide are removed from the substrate before the solution of hydrogen peroxide is introduced onto the substrate.

5. The method of claim 3, wherein the substrate is a surface of a flow conduit or valve.

6. The method of claim 3, wherein the substrate is within a gas tower contactor.

7. The method of claim 3, wherein the solution of hydrogen peroxide is in the temperature range of ambient temperatures to about 80° C.

8. The method of claim 3, wherein the solution is about 5% (volume) to about 50% (volume) aqueous solution of hydrogen peroxide.

9. The method of claim 1, wherein the reaction of amorphous dithiazine with hydrogen peroxide proceeds by the following reaction scheme:

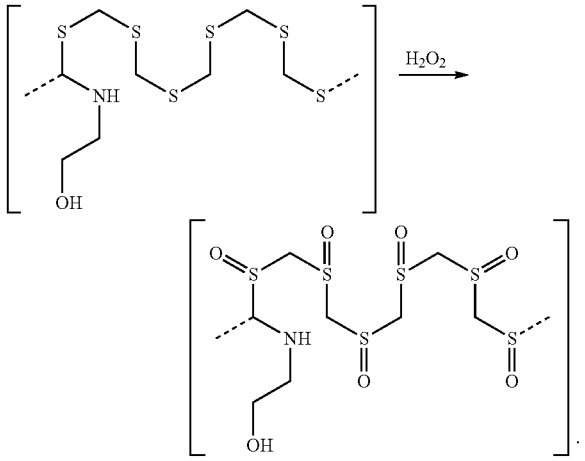

* * * * *